United States Patent [19]

Bogert

[11] 4,084,716

[45] Apr. 18, 1978

[54] SAFETY CLOSURE FOR CONTAINERS

[76] Inventor: Clayton Bogert, 118 Lowell Rd., Glen Rock, N.J. 07452

[21] Appl. No.: 720,868

[22] Filed: Sep. 7, 1976

Related U.S. Application Data

[63] Continuation of Ser. No. 516,231, Nov. 29, 1974, Pat. No. 3,979,001, which is a continuation-in-part of Ser. No. 311,119, Dec. 1, 1972, abandoned.

[51] Int. Cl.[2] ..... B65D 55/02; B65D 85/56; A61J 1/00

[52] U.S. Cl. ..... 215/217

[58] Field of Search ..... 215/216, 217

[56] References Cited

U.S. PATENT DOCUMENTS

| | | | |
|---|---|---|---|
| 2,776,066 | 1/1957 | Thornton | 215/217 |
| 3,445,022 | 5/1969 | Cilluffo | 215/216 |
| 3,741,421 | 6/1973 | Wittwer | 215/217 |
| 3,888,376 | 6/1975 | Cooke | 215/217 |

*Primary Examiner*—George T. Hall

*Attorney, Agent, or Firm*—Arthur A. March

[57] ABSTRACT

The invention provides a protective or safety closure which inhibits inadvertent opening of the container. The neck portion of the container itself is provided with threads along which a notched portion, for example, in the form of serrations, is provided. The interior of the cap itself is also provided with threads which cooperatively engage the threads in the neck portion. Along the threads in the cap a notched portion, such as in the form of serrations, is provided to engage the serrations of the neck portion to lock the cap in position. Resilient members are also provided on the underside of the cap portion to engage the top of the neck portion which perform the function of bringing the notched portion in the cap into engagement with the notched portion on the neck of the container. In order to disengage the parts it is merely necessary to manually depress the cap portion against the action of the resilient members such as springs whereby the serrations are displaced out of engagement and the cap may be turned to open the container.

10 Claims, 13 Drawing Figures

FIG. 6
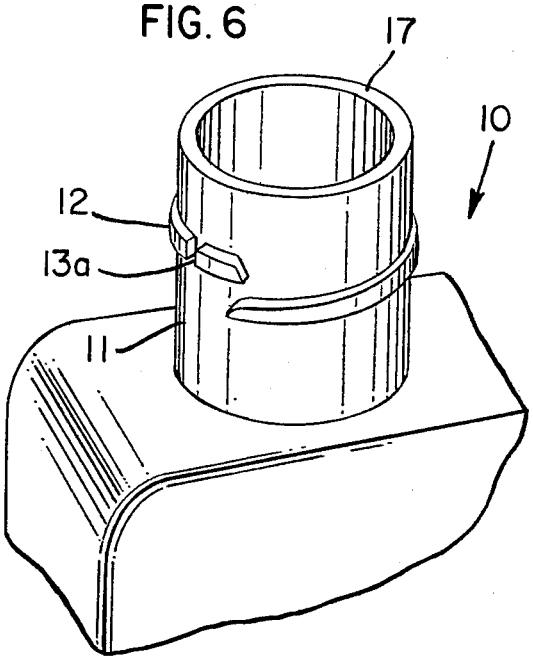
FIG. 8
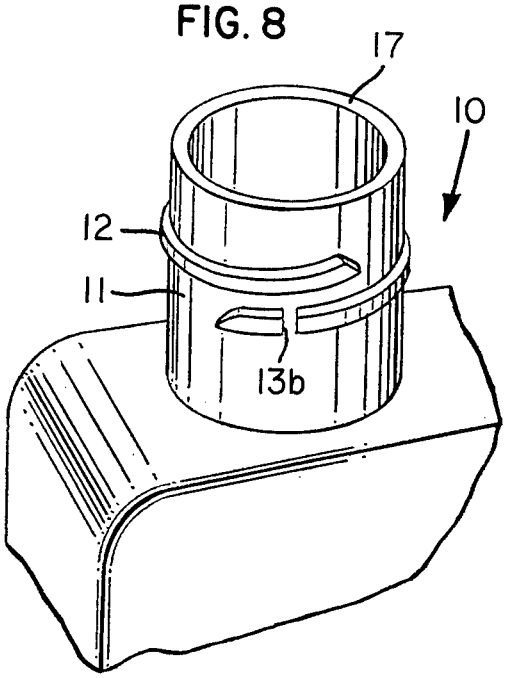
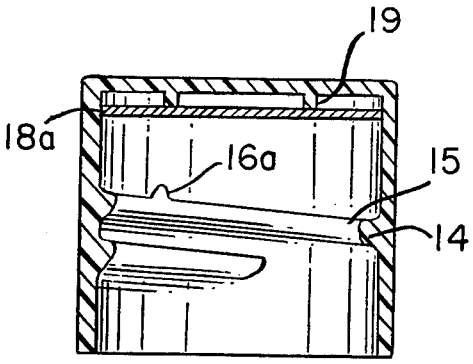
FIG. 7
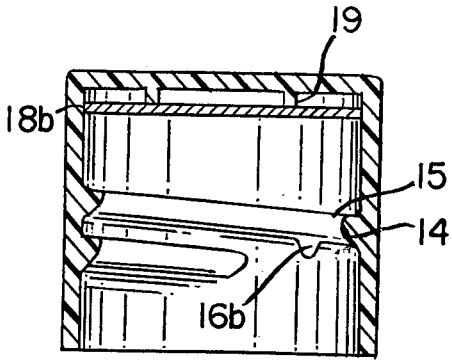
FIG. 9

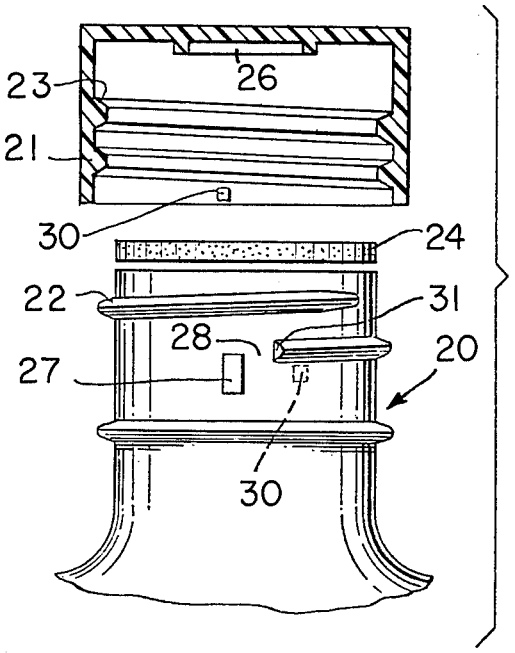
FIG. 10
FIG. 12
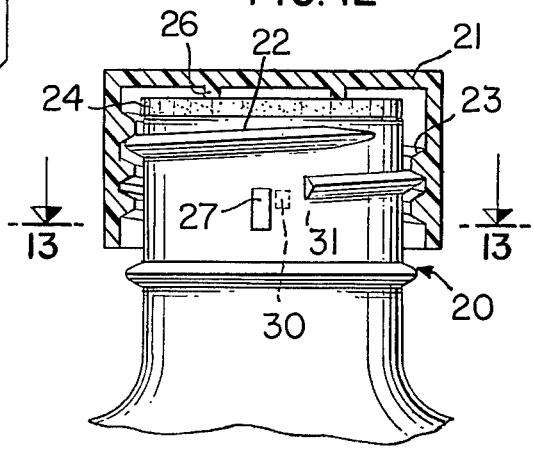
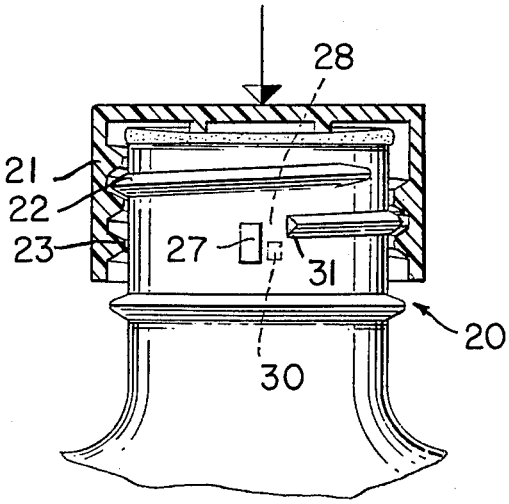
FIG. 11
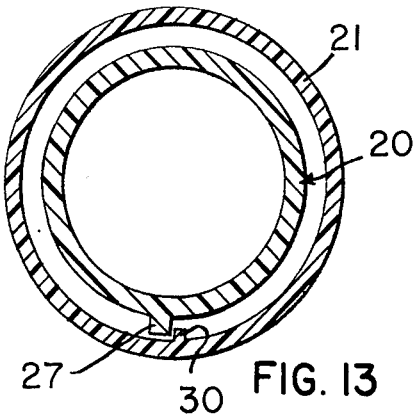
FIG. 13

SAFETY CLOSURE FOR CONTAINERS

This is a continuation of copending application Ser. No. 516,231, filed Nov. 29, 1974, now U.S. Pat. No. 3,979,001, which in turn is a continuation-in-part of copending application Ser. No. 311,119, filed Dec. 1, 1972 and now abandoned.

A novel modification of the notch portion is an arrangement wherein the notch is accomplished in the form of a space between the end of the thread and a protruding stop on the neck of the container. In one such form, the stop extends downwardly from a point no higher than the plane of the upper portion of the thread to a point below the plane of the lower portion of the terminus of the thread. The interior of the cap is provided with a protrusion in the form of a nib or the like which extends adjacent the terminus of the cooperating thread on the interior of the cap. When the cap is tightened on the neck by rotating in a clockwise direction, the protrusion on the interior of the neck of the cap rides below the threads until it engages the stop on the neck of the container and further rotation is inhibited. The protrusion is beyond the end of the threads and the cap is then released. Under the pressure of the resilient or pressure member in the underside of the cap portion, the cap returns to its normal position and the protrusion is disposed in the notch or space between the terminus of the thread on the nect of the container and the stop. Thus, inadvertent rotation in either direction is prevented. In order to open the cap and disengage the parts it is necessary to exert downward pressure on the cap itself and to rotate the cap counterclockwise to an open position.

The present invention relates to a protective or safety closure adaptable for use on containers having both liquid and dry products which inhibits inadvertent opening of the container and the exposure of the contents of the container to children.

BACKGROUND OF THE INVENTION

There has been a long-standing problem involving closures for containers containing relatively dangerous chemicals, medicines, and the like in that the closures could be readily and easily opened with facility and the contents exposed for intake by children and others who are not aware of the dangers involved.

There have been many attempts to provide safety closures which require additional manual manipulation other than merely unscrewing or lifting the cap or closure before it can be removed. However, the heretofore-known proposals are either multipiece arrangements, cumbersome and unwieldy or necessitate a complete change in currently used equipment in order to provide for the necessary safety factors. As a consequence in some instances a positive lock is not effected and it has been expensive and time consuming to provide for the necessary new equipment.

SUMMARY OF THE INVENTION

The present invention has overcome the defects and disadvantages of safety closures proposed heretofore by providing a one-piece or one composite unit safety cap which is easily and readily affixed to the neck of a container and provides a completely positive lock, which resists inadvertent opening of the container. To accomplish this result means are provided which may be utilized with only minor modifications to current container and container closure producing equipment. These modifications are very inexpensive and not at all time consuming. In other words, by a relatively simple modification presently existing equipment can be used to produce a safety closure which meets all the required standards for such products.

As illustrated, the neck of the container of the present invention is provided with the conventional threaded portion, which is provided with notches in the form of serrations at the lower terminus of the threads. The closure itself is also conventionally threaded, with the threads cooperating with those on the neck of the container. Here again, means are provided, such as serrations at the lower terminus of the threads in the closure, which cooperatively engage with notched or serrated portions on the neck of the container.

Therefore, the present invention provides a threaded neck portion for a container having notches or serrations at the lower terminus thereof. The container's closure has a threaded portion which cooperates with the threaded portion on the neck of the container and which is provided with means such as serrations at the lower terminus thereof. When the container is screwed onto the neck portion it will ride freely in the normal fashion over the threads. When the closure is fully threaded onto the neck portion the pressure is released and resilient members which are provided under the top of the closure engage with the top of the neck portion of the container. The action of the resilient member causes the closure to be lifted whereby the notches and serrations on the neck of the container and in the closure cooperatively engage each other to lock the cap in position against any inadvertent movement. In order to open the container, it is only necessary to manually depress the closure against the action or pressure of the spring or other resilient member whereby there is disengagement of the notches or serrations in the closure from those in the neck of the container and thereafter by merely unscrewing, the closure may be removed to expose the contents.

In a novel and unique arrangement contemplated herein, utilizing present day closures with very little modification, a unique and different safety cap closure is accomplished. In this form a conventional cap and container are utilized. The stop is a molded notch and is a part of the neck of the container spaced from the end of the thread portion on the container. The stop extends a slight distance below the point of the terminus of the threads and extends no higher than the plane of the upper portion of the terminus of the threads. This structure leaves a space, e.g., laterally and rotationally, between the terminus of the threads and the stop. A protrusion on the interior of the cap is correspondingly disposed beyond the terminus of the threads on the cap and rides under the threads on the neck of the container when the cap is tightened thereon until such point where it engages the stop provided on the neck of the container. As aforesaid, pressure means in the form, for example, of a resilient member are provided underneath the cap and when the protrusion on the cap reaches or engages the stop on the neck of the container, the protrusion clears the terminus of the threads and the cap is released and moves slightly upwardly under the force of the pressure member whereupon the protrusion slides into the space or notch between the terminus of the threads and the stop on the neck of the container. In this position, inadvertent movement of the cap in either rotational direction is effectively prevented and it is necessary to exert downward pressure which is on the pressure means via the cap to remove the protrusion from the space or notch and turn the cap which is to be opened. Such action would not be accomplished inadvertently but only by a person knowledgeable in the field.

While, hereinafter, the invention is described in connection with one illustrative form thereof, it will be understood that the illustration and accompanying description is merely to facilitate an understanding of the invention and is in no way intended to limit the scope thereof.

In the drawings:

FIG. 6 is a perspective view of part of a similar container showing the neck portion with a notch at the upper portion of the thread.

FIG. 7 is a sectional view of the closure of the container with a protrusion at the upper portion of the thread.

FIG. 8 is a perspective view of part of a further container showing the neck portion with a notch at the lower portion of the thread.

FIG. 9 is a sectional view of the closure of the container with a protrusion at the intermediate portion of the thread.

FIG. 10 is a side plane exploded view of the neck portion of another preferred container having a stop spaced from the end of the threads and of the coacting closure of the container partly in section, showing in dotted lines, the positional relation to the threads and stop on the container of the protrusion on the interior of the closure.

FIG. 11 is a side plane view partly in section of the neck of the container and the closure of FIG. 10 showing the position of the stop and the protrusion while the closure is being threaded on the container.

FIG. 12 is a side plan view partly in section of the neck of the container and the closure showing the safety position of the stop and the protrusion after the closure has been threaded on the container.

FIG. 13 is a sectional view along the lines 13—13 of FIG. 12.

Figure 1:
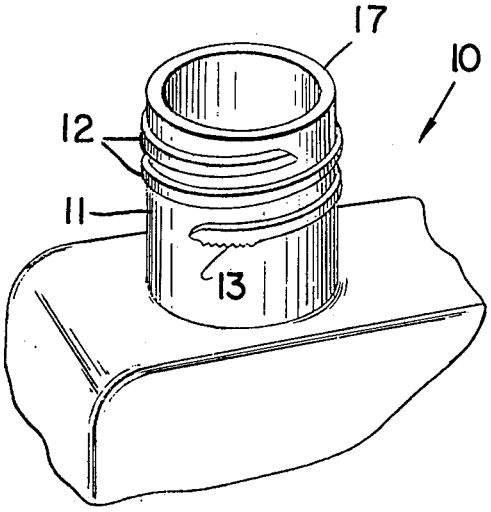
FIG. 1 is a perspective view of part of a container showing the neck portion of the present invention.
Figure 2:
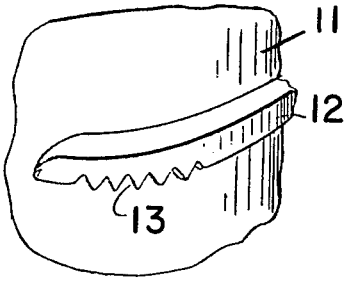
FIG. 2 is an enlarged view of the notched or serrated portion of the neck of the container.
Figure 3:
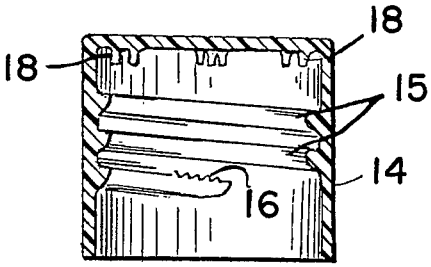
FIG. 3 is a sectional view of the closure of the container.
Figure 4:
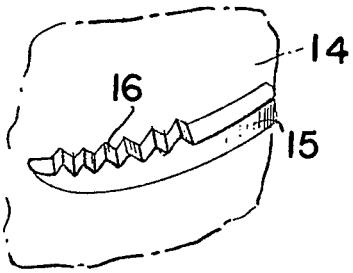
FIG. 4 is an enlarged view of the notched or serrated portion in the closure.

Referring specifically to the drawings, a conventional container 10 is provided which, while preferably made of plastic, may be made of glass or any suitable material. The container has the usual relatively elongated neck portion 11 provided with threads 12 which, when the container is made of plastic, may be molded. In the illustrated form the lower terminus of the threaded portion 12 is provided with a notch portion or serrations 13. Such structure may be provided directly in the mold and conventional molds to provide threads may be utilized with this minor modification. Thus, the equipment usually used for providing containers or the threaded neck portion requires a minimal amount of change.

The closure or cap 14 is also of conventional design and has internal threads 15 which cooperate with threads 12 on the neck of the container so that the closure may be screwed into position in the customary fashion. The lower terminus of the threaded portion 15 is provided with serrations 16 which face in the opposite direction to the serrations 13 on the neck 11.

The top of the neck has the usual bearing surface 17. The underside of the cap 14 has resilient members 18 which may be in the form of miniature springs which also can be molded into the cap when it is made of plastic. The springs 18 bear or resiliently press against the surface 17 of the top of the neck portion of the container, thus acting as pressure means.

In assembling the closure to the neck of the container it is merely necessary to manually turn the closure in the normal manner to screw the closure onto the neck of the container. When the closure is fitted onto the neck of the container and released the action caused by the resilient members 18 bearing on the surface 17 will cause the cap to move to a slight degree upwardly and interengage the notched portion 16 in the interior of the cap with the serrations 13 on the neck of the container. This causes a positive lock and the container may not be inadvertently opened as the cooperative engagement between the notched portions 16 and serrations 13 prevent any turning of the closure. In order to open the closure it is necessary to exert a downward pressure against the action of the resilient members 18 whereupon the notched or serrated portions 16 in the closure will be thrust out of engagement with the notched portions or serrations on the neck of the container and in the same movement the closure may be turned to unscrew the same from the neck of the container.

Thus, it may be seen that the present invention provides a one-piece safety closure obtaining a positive lock against inadvertent opening with a relatively simple modification to existing forms and equipment and without the necessity of cumbersome parts or expensive additional machinery.

Figure 5:
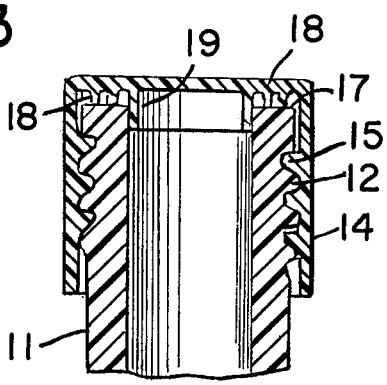
FIG. 5 is a sectional view of the neck portion of the container, with the closure attached thereto.

As illustrated in FIG. 5, in order to insure the appropriate seal, should the container have liquids therein, a flange portion 19 is provided which when the container is closed is disposed on the inner portion of the neck and sequentially engage the same for a seal-tight fit. As a consequence, the present invention provides a totally sealed container, with a safety closure in which there can be no inadvertent opening by children or others who are not acquainted with the contents.

In the foregoing description the notched portions or serrations have been described as being in the lower terminus of the threaded portions in the closure and on the neck of the container. It will be understood that these notched portions may be disposed at any point along the threads. Furthermore, while several notched portions have been illustrated, it will be further understood that a lesser member or more may be utilized.

As is illustrated in FIGS. 6 and 7, a notch or break in the surface **13*a* of the thread, is provided in and cooperates with the protrusion 16*b* on the upper portion of the thread 15 in the closure 14. The spring or pressure element is illustrated in the form of a flexible or resilient plate 18*a* which is disposed within the closure. A ring 19 may be molded into and depend from the underside of the top of the closure or cap 14. In assembling this closure as shown in FIGS. 6 and 7, the closure or cap 14 is turned in a clockwise direction on the neck until such time as the protrusion 16*a* is below the notch 13*a*. During this movement, pressure is exerted against the plate 18***a* and the plate flexes or if the plate is resilient it compresses. When the protrusion 16*a* is below the notch 13*a*, the pressure of the plate will cause the protrusion to engage within the notch 13*a* and lock the parts in position. To open the closure, it is only necessary to exert downward pressure on the closure 14 against the action of the plate 18*a* whereupon the closure may be turned in a counterclockwise direction until it is removed from the neck of the container.

FIGS. 8 and 9 disclose a notch or break in the surface 13*b* provided in the lower portion of the thread 12 on the neck 11 which cooperates with a protrusion 16*b* on the intermediate portion of the thread 15 in the closure 14. The protrusion 16*b* is disposed below the underside of the thread 15 as shown. The spring or pressure element is also in the form of a flexible or resilient plate 18*b* which is fitted within the closure. A ring 19 may be molded with and depend from the underside of the top of the closure. To place the closure 14 in position on the neck 11, it is turned on the threads of the neck in a clockwise direction whereby the 18*b* will be flexed or give under pressure. When the protrusion 16*b* is under the notch 13*b*, the pressure of the plate 18*b* will cause the protrusion to snap within the notch and the cap cannot be inadvertently removed because of the action between the threads. To open the closure, it is necessary to exert downward pressure on the closure 14 whereupon the protrusion 16*b* will come out of the notch 13*b* and closure 14 can be turned in a counterclockwise direction to open the container.

As illustrated, FIGS. 10 through 13 show a preferred form of a container 20 and closure or cap 21 therefor. The container is provided with conventional threads 22 and the cap is also provided with a conventional cooperative threaded portion 23. A pressure element illustrated in the form of a flexible or resilient plate 24 is provided within the closure near the top portion thereof. A ring 26 is molded into and depends from the underside of the top of the cap as shown.

In accordance with the present invention a stop 27 is molded into and is a part of the neck of the container. This stop is spaced a relatively short distance from the end of the threaded portion 22 and, as illustrated, a slight distance below the point of the terminus of the threads 22, leaving a space 28 for the purposes hereinafter set forth. Further, in accordance with the invention, a protrusion 30 is molded into and is a part of the interior of the cap 21. This protrusion is disposed at a point at or near the terminus of the threads 23 in the cap 21.

In assembling the closure and container of FIGS. 10–13, the closure or cap 21 is turned in a clockwise direction on the neck with the protrusion 30 on the cap 21 riding below the threads 22 on the neck portion 20 as indicated in the dotted line position shown in FIG. 10. During this movement downward pressure may be exerted on the cap 21. This movement causes the ring 26 to press against the plate 24 and the plate flexes or, if the plate is resilient, a compressing action takes place. Continued rotation of the cap will ultimately cause the protrusion 30 to engage the stop 27 to prevent any further rotation of the cap on the neck portion. The protrusion 30 and stop 27 are then disposed in the position shown in FIG. 11, i.e., abutting each other. Release of downward pressure of the closure or cap 21 causes it to move upwardly against the action of the plate 24 and the stop 27 and protrusion 30 are in the relative positions shown in FIG. 12 with the protrusion 30 being adjacent to the terminal point of the thread 22. In this position any attempt to move the closure 21 in a counterclockwise direction or to open the container will be prevented by the engagement of the protrusion with the edge 31 of the thread portion 22.

With the construction of the present invention little, if any, downward pressure need be exerted to tighten the cap 21 on the neck 20 of the container. The protrusion 30 is disposed below the track of the threads 22 as the cap is closed on the neck and under the action of resilient plate 24 is guided on the underside of the threads 22 with consequent flexing or compression of the plate. When the protrusion reaches space a portion of the stop 27 preferably extends, as shown, above the plane of the bottom of the terminus of the threads 22. This construction prevents further turning of the cap in a clockwise direction even after the pressure on the cap is released which is a distinct advantage. It is to be understood, however, that the safety closure feature, that is, preventing inadvertent opening of the cap can be accomplished even if the stop 30 is disposed entirely below the plane of the terminus of the threads 22.

In order to open the container, it is necessary to exert pressure downwardly on the closure to flex or compress the plate 24 under the action of the ring 26, whereupon the protrusion 30 will assume the position shown in FIG. 11, that is, one in which the protrusion 30 is disposed below the end of the threaded portion 22. Continued counterclockwise movement will permit the cap to be rotated with the protrusion 30 sliding underneath the threads 22 until ultimate release.

In accomplishing the safety features of the closure of the present invention, positive means of various types may be used to engage the pressure means which can be in the form of a resilient means or biasing means effectively temporarily deformable out of its normal plane, e.g., flexible leaf spring, plate spring, etc., or effectively temporarily deformable or compressible within itself by local change or reduction in size, thickness, volume or the like, e.g., sponge, foam, cellular or lighter yet uniform density resilient material such as rubber or plastic in annular or disc or plate form. Such flexible or compressible deformation of the pressure means causes temporary absorbing of the manual forces exerted on the closure and container neck during the final closing operation and the initial opening operation. Therefore, by selectively adjusting the magnitude of the threshold counterforce, i.e., deformation or force-absorbing properties, of the pressure means and/or of the material of which it is composed, which must be overcome by the manual forces needed to close and especially to open the container so that the average manual force of a child is sufficiently exceeded, an additional safety factor is provided.

It will be understood that this relatively simple construction provides for a very effective and efficient safety closure in which all the positive elements necessary to prevent inadvertent opening while maintaining a sealed container are present.

It is noteworthy that this accomplishment of very highly desired features required of a safety closure is obtained with the use of a conventional cap and container which is very inexpensively modified by the provision of the stop and the protrusion, thereby saving an enormous amount of cost in attaining the desired results.

While the invention has been described in detail in connection with one embodiment thereof, the description and illustration are in no way intended to limit the scope of the invention.

I claim:

1. A safety closure for containers comprising a continuous threaded neck portion, a notched portion formed in the continuous threads on said neck portion, a cap provided with continuous threads for cooperatively engaging the threads on said neck portion, and having means for maintaining the cap in threaded engagement with said neck portion in axially resilient relation and in radially fixed relation thereto in any position of movement thereof, and means formed in the threads on the cap and together with the threads on the cap being integrally fixed against displacement with respect to the cap and disposed to engage the notched portion on the neck to lock the cap in position and inhibit inadvertent opening of the container.

2. The invention as defined in claim 1 in which the notched portion on the neck comprises serrations and the means on the cap which engage the notched portion on the neck also comprise serrations which cooperatively engage with the serrations on the neck.

3. The invention as defined in claim 2 in which the cooperative serrations on the neck and cap are approximately at the lower terminus of the threaded portions.

4. The invention as defined in claim 1 comprising, in addition, a resilient member disposed between the underside of the top of the cap and the top of the neck portion.

5. The invention as defined in claim 1 comprising, in addition, a flange extending between the underside of the top portion of the cap and the inner wall of the neck portion.

6. A safety closure for containers comprising a neck portion provided with continuous threads and axially extending serrations formed in the threads, a cap provided with continuous threads cooperatively engaging the threads on the neck portion and maintaining the cap in radially fixed relation in covering position on the neck portion and axially extending serrations formed in the threads on the cap cooperatively engaging the serrations formed in the threads on said neck portion; and axially resilient members interposed between the underside of the top of the cap and the top of the neck portion.

7. A safety closure for containers comprising a neck portion provided with a continuous thread and an axially extending notch portion formed in the thread, a cap provided with a continuous thread cooperatively engaging the thread on the neck portion and maintaining the cap in radially fixed relation in any position of movement in covering relation on the neck portion and an axially extending protrusion formed in the thread on the cap cooperatively engaging the notch portion formed in the thread on said neck portion; and a resilient member interposed between the underside of the top of the cap and the top of the neck portion.

8. The invention as defined in claim 7 in which the notch portion on the neck portion is approximately near the top of the neck portion and the protrusion on the cap is approximately near the top of the cap.

9. The invention as defined in claim 7 in which the thread on the neck portion is a continuous thread having uniform edges except for the notch portion.

10. The invention as defined in claim 9 in which the thread on the cap is a corresponding continuous thread having uniform edges except for the protrusion.

* * * * *